United States Patent [19]

Brown

[11] 4,150,463

[45] Apr. 24, 1979

[54] ADJUSTABLE LENGTH STRIP FASTENER

[76] Inventor: Dwight C. Brown, 1516 N. Nicholas St., Arlington, Va. 22205

[21] Appl. No.: 720,248

[22] Filed: Sep. 3, 1976

[51] Int. Cl.[2] ..... B65D 63/00

[52] U.S. Cl. ..... 24/16 PB; 24/30.5 P; 24/206 A; 248/74 PB

[58] Field of Search ..... 24/206, 16 PB, 30.5 P, 24/17 AP, 17 B, 206 A; 248/74 PB; 160/231 A

[56] References Cited

U.S. PATENT DOCUMENTS

| | | | |
|---|---|---|---|
| D. 237,781 | 11/1975 | Brown | D9/252 |
| 2,961,785 | 11/1960 | Toeffer | 24/16 PB |
| 3,019,486 | 2/1962 | Stinson | 160/231 A |
| 3,224,054 | 12/1965 | Lige | 24/16 PB |
| 3,438,095 | 4/1969 | Evans | 24/16 PB |
| 3,744,094 | 7/1973 | Bach | 24/16 PB |
| 3,913,178 | 10/1975 | Ballin | 24/16 PB |
| 3,913,179 | 10/1975 | Rhee | 24/16 PB |
| 3,955,245 | 5/1976 | Ballin | 24/201 C |
| 3,955,246 | 5/1976 | Tanaka | 24/16 PB |
| 3,973,610 | 8/1976 | Ballin | 24/16 PB |

FOREIGN PATENT DOCUMENTS

| | | | |
|---|---|---|---|
| 224262 | 5/1959 | Australia | 24/16 PB |
| 753420 | 7/1949 | Fed. Rep. of Germany | 24/16 PB |
| 796222 | 1/1936 | France | 24/16 PB |
| 1278571 | 10/1961 | France | 24/16 PB |
| 360840 | 4/1962 | France | 24/16 PB |

*Primary Examiner*—Victor N. Sakran

[57] ABSTRACT

An adjustable length strip fastener is disclosed which comprises a strip of semi-rigid plastic. A plurality of uniformly and longitudinally spaced and aligned openings are defined in the strip. The openings are disposed over the entire length of the strip and are centrally disposed between the longitudinal edges of it. A longitudinally extending narrow groove is also defined in one of the surfaces of the strip. The groove is centrally disposed between the longitudinal edges of the strip and extends continuously from one end thereof to the other except at the openings. As a result, the narrow groove forms a hinge along which the strip may be folded. In use, one end of the strip can be folded along the hinge and passed through one of the openings adjacent the other end of the strip to form a loop which can be locked. Alternatively, the hinge may be formed by a plurality of small apertures cut through the strip.

10 Claims, 23 Drawing Figures

FIG. 1
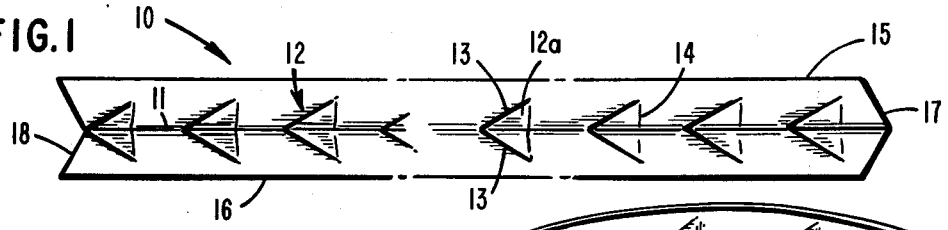
FIG. 3
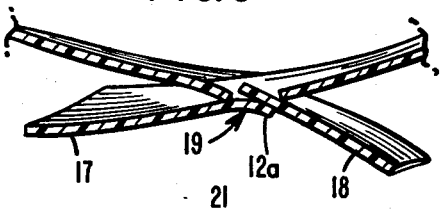
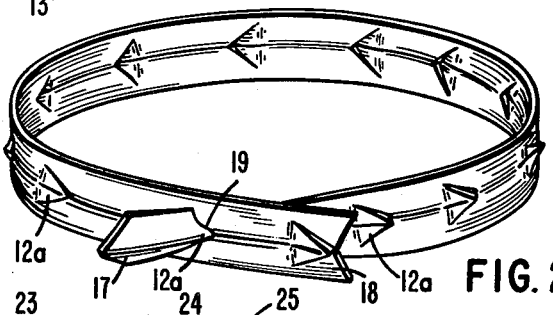
FIG. 2
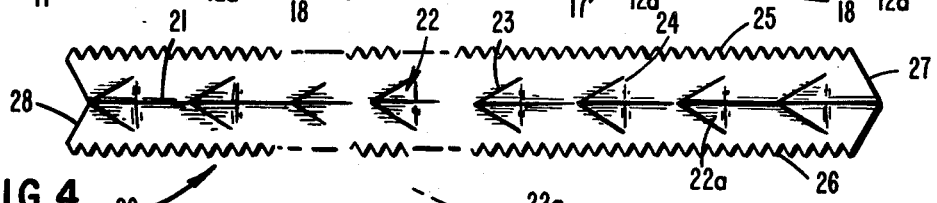
FIG. 4
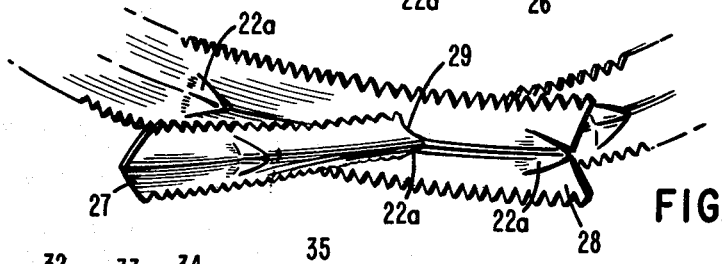
FIG. 5
FIG. 6
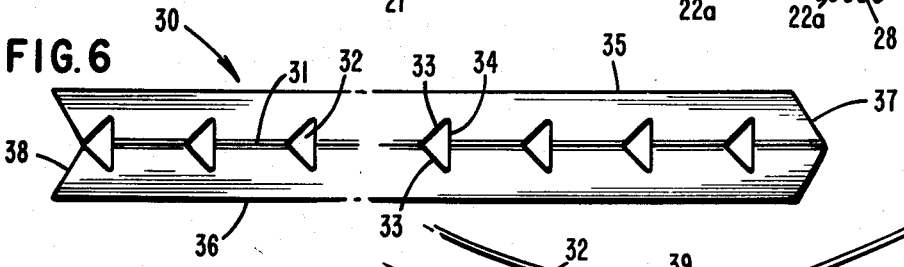
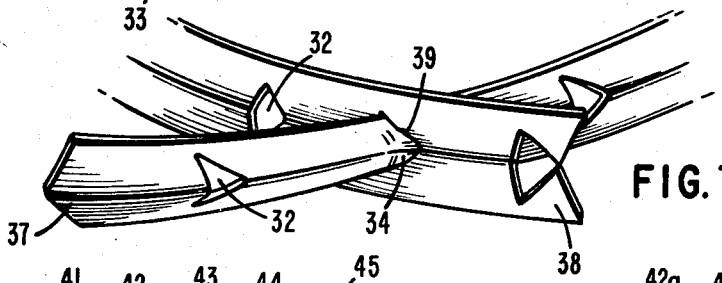
FIG. 7
FIG. 8
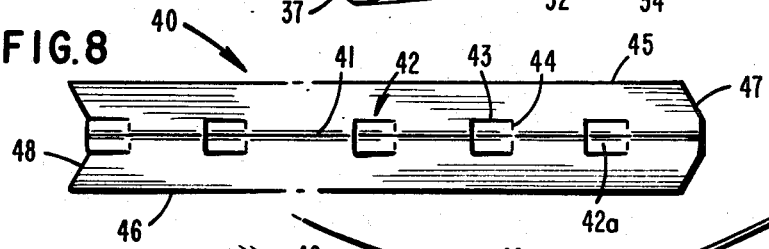
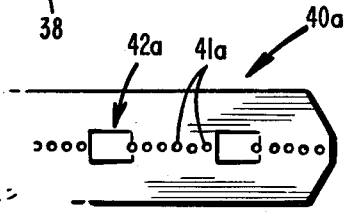
FIG. 8a
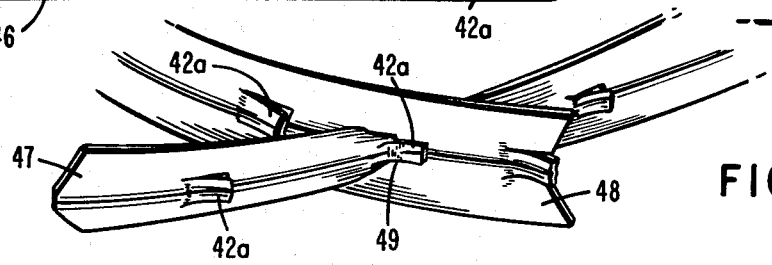
FIG. 9

FIG. 10
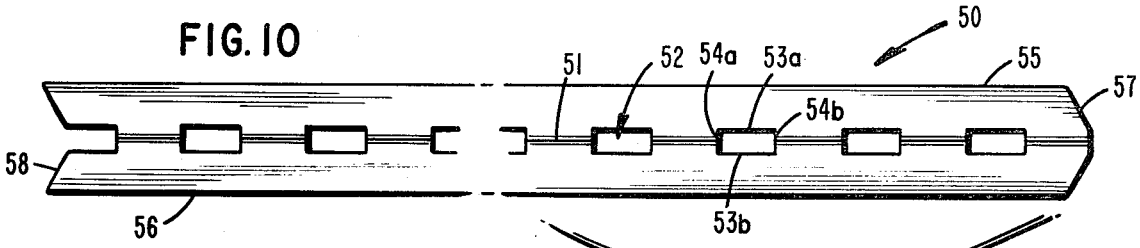
FIG. 11
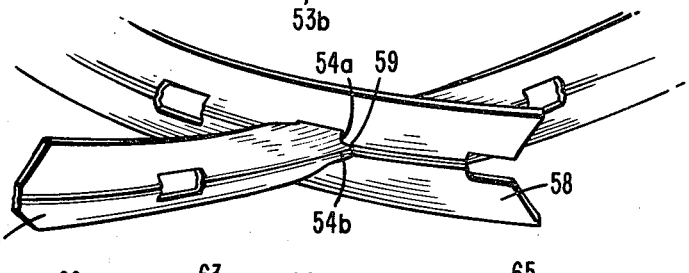
FIG. 12
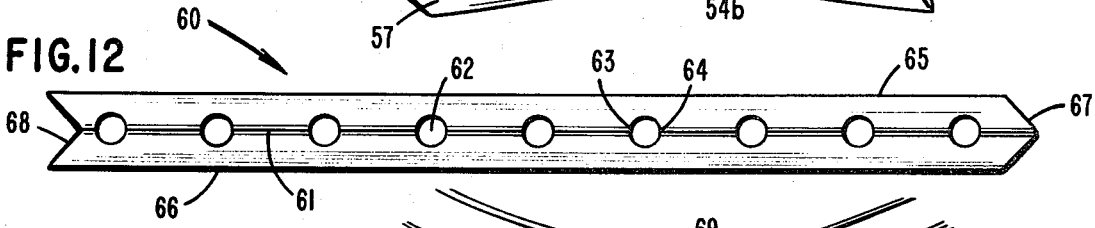
FIG. 13
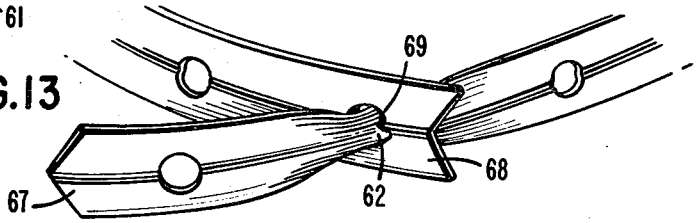
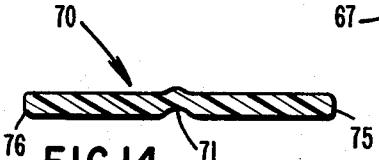
FIG. 14
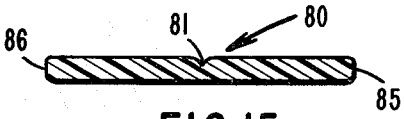
FIG. 15
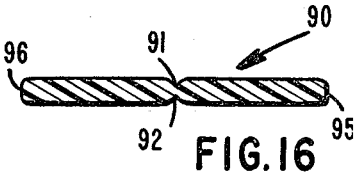
FIG. 16
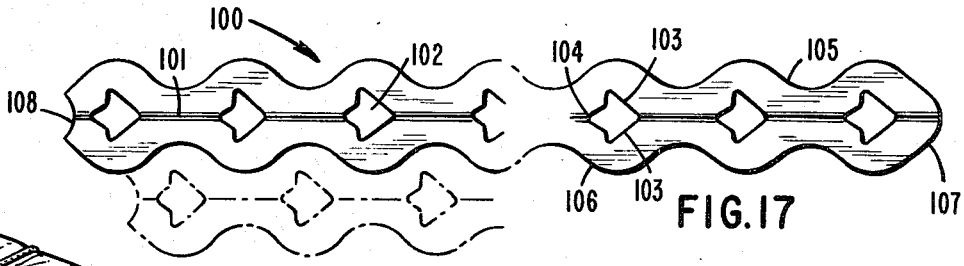
FIG. 17
FIG. 21
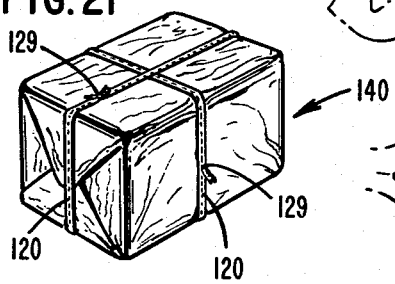
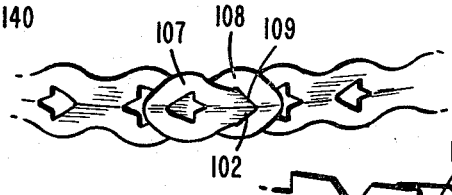
FIG. 18
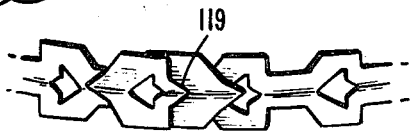
FIG. 20
FIG. 22
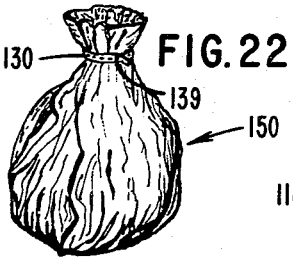
FIG. 19
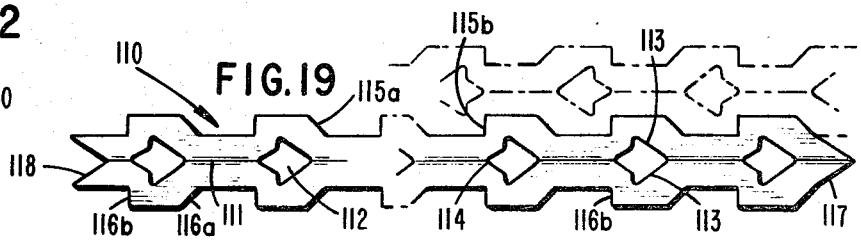

ADJUSTABLE LENGTH STRIP FASTENER

BACKGROUND OF THE INVENTION

1. Field of the Invention

This invention relates to both expendable and reusable strip fasteners used for example for fastening and closing bags, for banding packages and bundles, for tying plants to stakes, etc. More particularly, this invention relates to an adjustable length strip fastener in which any desired length of fastener can be cut from a continuous fastener strip or roll of stock fastener material.

2. Description of the Prior Art

Most strip fasteners available today are not readily foldable along their longitudinal axis. As a result, one end of those fasteners cannot be readily inserted through an aperture in the other end for locking the fastener. Therefore, these fasteners are not efficiently and easily usable. Additionally, such fasteners cannot be readily cut from a continuous strip or roll of stock fastener material.

It is an object of this invention to provide an improved adjustable length strip fastener.

It is a further object to provide an adjustable length strip fastener having a narrow longitudinally extending groove defined in one of its surfaces for providing a spring hinge to permit easy folding and insertion of one end of the fastener through an opening adjacent the other end thereof and for positive locking engagement of the fastener in a manner which allows easy unlocking, particularly for any desired reuse.

It is a still further object of this invention to provide an adjustable length strip fastener having a plurality of small apertures spaced a small distance from each other along the longitudinal central axis of and cut through the strip for providing a spring hinge to permit easy folding and insertion of one end of the fastener through an opening adjacent the other end thereof and for positive locking engagement of the fastener in a manner which allows easy unlocking, particularly for any desired reuse.

Another object of the invention is to provide an adjustable length strip fastener which is simple in construction and inexpensive.

A further object of the invention is to provide a variable length strip fastener which can be cut to any desired length by manual or mechanical cutting.

Another object of this invention is to provide an adjustable length strip fastener having improved and stronger locking ability.

A further object of the invention is to provide an adjustable length strip fastener which, because of its longitudinal center hinge spring action, allows insertion of one end of the strip fastener through a minimum size opening adjacent the other end thereof so as to provide a high ratio of fastener strength per width and thickness of material used. With such hinge construction, the width of the openings in the strip fastener can be decreased if desired and thereby increase the overall strength of the fastener.

Other objects will be covered in the following description with reference to the accompanying drawing wherein:

FIG. 1 is a plan view of a first embodiment of the invention;

FIG. 2 is a perspective view of the first embodiment in fastened position;

FIG. 3 is an enlarged cross-sectional view of a portion of FIG. 2;

FIG. 4 is a plan view of a modification of the first embodiment;

FIG. 5 is a perspective view of the modification of the second embodiment in fastened position;

FIG. 6 is a plan view of a second embodiment of the invention;

FIG. 7 is a perspective view of the second embodiment in fastened position;

FIG. 8 is a plan view of a third embodiment of the invention;

FIG. 8*a* is a plan view of a modification of the third embodiment;

FIG. 9 is a perspective view of the third embodiment in fastened position;

FIG. 10 is a plan view of a fourth embodiment of the invention;

FIG. 11 is a perspective view of the fourth embodiment in fastened position;

FIG. 12 is a plan view of a fifth embodiment of the invention;

FIG. 13 is a perspective view of the fifth embodiment in fastened position;

FIG. 14 is a transverse cross-sectional view of the invention;

FIG. 15 is another transverse cross-sectional view of the invention;

FIG. 16 is another transverse cross-sectional view of the invention;

FIG. 17 is a plan view of a sixth embodiment of the invention;

FIG. 18 is a perspective view of the sixth embodiment in fastened position;

FIG. 19 is a plan view of a seventh embodiment of the invention;

FIG. 20 is a perspective view of the seventh embodiment in fastened position;

FIG. 21 is a perspective view of a fastener of the present invention as applied to the banding of packages; and FIG. 22 is a perspective view of a fastener of the present invention used as a bag closure.

DESCRIPTION OF THE PREFERRED EMBODIMENTS

With reference to FIGS. 1 through 3, shown therein is a fastener 10 made of a strip of semi-rigid plastic material. One surface of the strip has a narrow longitudinally extending groove 11 defined therein which forms a hinge about which the strip may be folded. The fastener 10 has a plurality of uniformly and longitudinally spaced and aligned triangular openings 12 therein. The openings are disposed over the entire length of the strip and are centrally disposed between the longitudinal edges 15, 16 of the strip. Each of the triangular openings 12 is defined by a V-shaped slot having legs 13, 13 cut completely through the strip and a portion 14 of the strip which interconnects the free ends of the legs 13, 13 of the V-shaped slot. Each portion 14 is perpendicular to the longitudinal axis of the strip and a triangular tongue 12*a* projects from each of the portions 14 and normally fills each of the triangular openings. The groove 11 extends continuously from one end of the strip to the other except of course at the slots where the continuity of the groove is broken. Advantageously, one end 17 of the strip may be cut into a V-shape and the other end 18, may be tapered as shown in FIG. 1.

When assembled for fastening, the end 17 of the strip may be folded along the groove 11 and inserted through one of the triangular openings 12 adjacent the other end 18 of the strip to form a loop. The end 17 is pulled through the opening until the desired loop size is obtained and is then pulled back until, as shown in FIG. 2, one of the tongues 12*a* adjacent the end 17 hooks over one of the V-shaped slots having legs 13, 13 adjacent the other end 18 of the strip to securely lock at 19 the fastener 10 as shown in FIG. 3.

A modification of the first embodiment of the invention is shown in FIGS. 4 and 5. Shown in those figures is a fastener 20 made of a strip of semi-rigid plastic. One surface of the strip has a narrow longitudinally extending groove 21 defined therein which forms a hinge about which the strip may be folded. The fastener 20 has a plurality of uniformly longitudinally spaced and aligned triangular openings 22 therein. The openings are disposed over the entire length of the strip and are centrally disposed between the longitudinal edges 25, 26 of the strip. Each of the openings 22 is defined by a V-shaped slot having legs 23, 23 cut completely through the strip and a portion 24 of the strip which interconnects the free end of the legs 23, 23 of the slot. Each portion 24 is perpendicular to the longitudinal axis of the strip and a triangular tongue 22*a* projects from each of the portions 24. The groove 21 extends from one end of the strip to the other except at the slots where the continuity of the groove is broken. One end 27 of the strip may be cut into a V-shape and the other end 28 may be tapered. In this embodiment however, the longitudinal edges 25, 26 are serrated from one end thereof to the other. As shown in FIG. 5, the serrations along the edges 25, 26 provide additional holding and gripping power for the fastener in the fastened position. The fastener 20 is formed into a loop like the fastener 10 of FIGS. 1 through 3 and one of the tongues 22*a* adjacent the end 27 hooks over at 29 one of the V-shaped slots adjacent the end 28 for fastening. In each of the embodiments to be subsequently described, it is also contemplated that the longitudinal edges of the fasteners can be serrated, particularly over the entire length thereof.

Shown in FIGS. 6 and 7 is a second embodiment of the invention in the form of a fastener 30 made of a strip of semi-rigid plastic material having a longitudinally extending groove 31 therein. A plurality of triangular openings 32 are defined in the fastener 30 by a through hole, triangular in cross-section cut in the strip. Each opening 32 includes a pair of edges 33, 33 and a back edge 34 which is perpendicular to the longitudinal axis of the strip. Again, in this embodiment, the fastener has a tapered front end 37, a tail end 38 and longitudinal edges 35, 36. For fastening, the end 37 may be folded along the groove 31 and passed through one of the openings 32 adjacent the other end 38 of the fastener to form a loop. After such insertion and when the desired loop size is obtained, the end 37 is moved back through the opening 32 until such time as the now partly folded edge 34 of one of the openings 32 adjacent the end 37 hooks over at 39 the edges 33 of the opening 32 adjacent the end 38 of the strip 30 to lock the fastener.

In FIGS. 8 and 9 is shown a third embodiment of the invention which includes a fastener 40 comprising a strip of semi-rigid plastic material having a longitudinally extending groove 41 defined therein. In this embodiment, rectangular openings 42 are provided and are defined by a substantially U-shaped slot 43 cut through the strip and the portion 44 of the strip interconnecting the free ends of the slot. Each of the portions 44 is perpendicular to the longitudinal axis of the strip. A rectangular tongue 43 projects from each of the portions 44 and normally fills the rectangular openings 42. Again, this fastener includes a tapered end 47, a tail end 48 and longitudinal edges 45, 46. In use for fastening, as shown in FIG. 9, the end 47 of the strip is folded along the groove 41 and passed through one of the openings 42 adjacent the end 38 to form a loop of desired size. The end 37 is then moved back toward that opening until such time as one of the tongues 42*a* hooks over at 49 the bight of the U-shaped slot 43 at the opening 42 adjacent the end 48 of the strip to lock the fastener.

Shown in FIG. 8*a* is a modification of the third embodiment in which a strip 40*a* is hinged along its longitudinal central axis by means of a plurality of small apertures 41*a* spaced a small distance from each other along the central longitudinal axis of and cut through the strip. It is contemplated in this invention that in each of the embodiments the longitudinal hinge of the fasteners could be formed by spaced apertures of the type shown in FIG. 8*a* in place of the longitudinal groove or grooves defined in the surface of the strip.

In FIGS. 10 and 11 is shown a fourth embodiment of the invention which comprises a fastener 50 made of a strip of semi-rigid plastic material having a longitudinal groove 51 defined therein. In this embodiment, each of the openings 52 is rectangular and is defined by a through hole, rectangular in cross-section, cut in the strip. Each opening 52 has two edges 53*a*, 53*b* parallel to the longitudinal edges 55, 56 of the strip and a pair of edges 54*a*, 54*b* perpendicular to those longitudinal edges. The fastener also includes a tapered front end 57 and a tail end 58. In use for fastening, as shown in FIG. 11, the end 57 may be folded along the hinge 51 and passed through one of the openings 52 adjacent the end 58 of the fastener to form a loop of desired size. The end 57 may then be moved back through that opening until such time as the now partly folded edge 54*b* of one of the openings 52 adjacent the end 57 hooks over at 59 the edge 54*a* of one of the openings 52 adjacent the end 58 of the strip 50 to lock the fastener.

Shown in FIGS. 12 and 13 is a fifth embodiment of the invention which comprises a fastener 60 made of a strip of semi-rigid plastic material having a longitudinally extending groove 61 defined therein. In this embodiment, each of the openings 62 is circular and is defined by a through hole, circular in cross-section. The fastener 60 includes straight longitudinal edges 65, 66, a front end 67, and a tail end 68. In use for fastening, the end 67 is folded along the hinge 61 and inserted through one of the circular openings 62 adjacent the end 68 to form a loop of desired size. As shown in FIG. 13, one of the now folded openings 62 adjacent the end 67 forms a semi-circular notch. This notch can hook at 69 over one of the openings 62 adjacent the end 68 of the strip to lock the fastener 60.

Shown in FIGS. 17 and 18 is a sixth embodiment of the invention which comprises a fastener 100 made from a strip of semi-rigid plastic material. The fastener 100 includes a longitudinal groove 101 defined in one surface and a plurality of substantially triangular shaped openings 102 formed therein by substantially triangular-shaped through holes cut through the strip. Each opening 102 has a pair of edges 103, 103 and a back edge 104, perpendicular to the longitudinal axis of the strip, in which may be cut a small notch. The fastener also includes longitudinal edges 105, 106 which are mirror images of each other about the central longitudinal axis of the strip. The strip 100 is narrower in the portion thereof between the openings 102 than in the portions thereof coextensive with the openings. Each of the edges 105, 106 are substantially in the form of a sine curve. When used for fastening, as shown in FIG. 18, the end 107 of the strip 100 is folded along the groove 101 and passed through one of the openings 102 adjacent the end 108 of the strip to form a loop of desired size in which one of the narrower portions of the strip, between next adjacent pair of the openings 102 adjacent the end 107 will engage at 109 the opening 102 adjacent the end 108 of the strip to lock the fastener.

Shown in FIGS. 19 and 20 is a seventh embodiment of the invention which comprises a fastener 110 made of a strip of semi-rigid plastic material. The fastener has a longitudinal groove 111 defined in one surface thereof and a plurality of substantially triangular shaped openings 112 formed therein by substantially triangular-shaped through holes cut through the strip. Each opening 112 has a pair of edges 113, 113 and a back edge 114, perpendicular to the longitudinal axis of the strip, in which may be cut a small notch. The fastener includes a pair of longitudinal edges 115, 116 and has a front end 117 and a tail end 118. Again as in the preceding embodiment, the portions of the strip between the openings 112 are narrower than the portions which are coextensive with the openings. The narrower portions of the longitudinal edges 115, 116 of the strip between the openings 112 and the portions thereof coextensive with the openings 112 are straight and parallel to the longitudinal axis of the strip and are interconnected by edge parts 115*a*, 115*b*, 116*a*, 116*b* which extend transversely of the strip. The edge parts 115*b*, 116*b* are perpendicular to the longitudinal axis of the strip. In use for fastening, the end 117 is folded along the hinge 111 and is passed through one of the openings 112 adjacent the end 118 of the strip to form a loop of desired size. For locking at 119, one of the narrower straight portions of the strip, between the next adjacent pairs of openings 112 adjacent the end 117, engage one of the openings 112 adjacent the end 118 of the strip and the edge parts 115*b*, 116*b* will abut the portion of the strip coextensive with that one opening 112 adjacent the end 118 to lock the fastener.

FIGS. 14 through 16 are transverse cross-sectional views of the above-described embodiments of the invention showing various manners in which the longitudinal grooves 11, 21, 31, 41, 51, 61, 101, and 111 may be provided in the fasteners. In FIG. 14, the fastener 70 has longitudinal edges 75, 76 and a groove 71 defined, for example, by rolling in the lower surface and a corresponding longitudinal hump in the upper surface. As shown in FIG. 15, the fastener designated 80, has longitudinal edges 85, 86 and a longitudinally extending groove 81 cut in the upper surface thereof. As shown in FIG. 16, the fastener 90 has longitudinal edges 95, 96 and longitudinally extending grooves 91, 92 cut in the upper and lower surfaces respectively of the fastener.

As shown in FIG. 21 a pair of fasteners 120, corresponding to any of the above-described embodiments of the invention can be locked at 129 to band a package 140. Also, as shown in FIG. 22, a fastener 30, corresponding to any of the above-described embodiments of the invention, can be locked at 139 to close a bag 150.

It is contemplated in this invention that any of the above-described embodiments can be made from a semi-rigid plastic. For example, the fasteners may be made of polyethylene, polypropylene, polyvinyl chloride, or the like. It is also contemplated in this invention, that the fasteners can be cut from a continuous strip of fastener material or from a roll of stock fastener material. Also, as noted above, it is contemplated in this invention that the longitudinal edges of the fasteners of each of the above-described embodiments could be serrated, particularly over their entire length.

It is evident from the above description of the embodiments of the invention, that each embodiment may include a longitudinal groove extending from one end thereof to the other. A hinge, along which the fastener may be folded, is created by the longitudinal groove defined in the surface of the fastener and is springy because of the resilience of the semi-rigid plastic, i.e., the fastener when folded tends to return to its original flattened condition. Alternatively, the hinge may be formed by a plurality of small closely spaced apertures cut through the strip as shown in FIG. 8*a*. This spring hinge feature offers the advantage of better securement of the fastener in fastened position. The degree of springiness that is provided allows manual folding, for example, by use of the thumb and forefinger, at the forward end of the fastener for easy insertion of that end through one of the openings in the other end of the fastener. After insertion of the one end of the fastener through an opening in the other end, the springiness of the fastener about the groove or hinge, biases the folded sides of the fastener outwardly toward its original flat shape against the sides of the opening to more securely lock the fastener.

With the longitudinal hinge formed in the strip fastener, it is also possible to use relatively narrower fastener material having substantial transverse cross-sectional rigidity. This material cannot be used for conventional fasteners because with such substantial transverse cross-sectional rigidity, they could not be folded. Thus, with the invention, a relatively heavy duty adjustable length fastener can be provided.

It is apparent from the foregoing that the invention provides a novel and improved adjustable length fastener which is useful for example for fastening and closing bags, for banding packages and bundles, for tying plants to stakes, etc.

What I claim is:

1. An adjustable length strip fastener comprising:

an elongated strip of semi-rigid plastic, means defining a plurality of uniformly and longitudinally spaced and aligned openings in said strip and disposed over the entire length thereof, each of said openings being centrally disposed between the longitudinal edges of the strip, and means defining a longitudinally extending hinge in the strip, said hinge being substantially centrally disposed between the longitudinal edges of the strip whereby said strip may be folded along said hinge and one end of said strip can be passed through one of said openings adjacent the other end thereof to form a loop which can be locked, said hinge defining means comprising a group of apertures between each next adjacent pair of said openings and cut through the strip substantially along the central longitudinal axis thereof, said apertures being of substantially smaller cross-sectional area than said openings and being substantially more closely spaced than said openings.

2. An adjustable length fastener comprising:

an elongated strip of semi-rigid plastic, means defining a plurality of uniformly and longitudinally spaced and aligned openings in said strip and disposed over the entire length thereof, each of said openings being centrally disposed between the longitudinal edges of the strip, means defining a longitudinally extending hinge in the strip, said hinge being substantially centrally disposed between the longitudinal edges of the strip whereby said strip may be folded along said hinge and one end of said strip can be passed through one of said openings adjacent the other end thereof to form a loop which can be locked, each of said openings is triangular and is defined by a V-shaped slot cut through the strip and the portion of the strip interconnecting the free ends of the slot, each of said portions being perpendicular to the longitudinal axis of the strip, and a triangular tongue projecting from each of said portions and normally filling the openings whereby when one end of said strip is folded and passed through one of the openings adjacent the other end thereof to form a loop one of the tongues adjacent said one end can hook over the V-shaped slot defining said one opening to lock the fastener.

3. An adjustable length fastener comprising:

an elongated strip of semi-rigid plastic, means defining a plurality of uniformly and longitudinally spaced and aligned openings in said strip and disposed over the entire length thereof, each of said openings being centrally disposed between the longitudinal edges of the strip, means defining a longitudinally extending hinge in the strip, said hinge being substantially centrally disposed between the longitudinal edges of the strip whereby said strip may be folded along said hinge and one end of said strip can be passed through one of said openings adjacent the other end thereof to form a loop which can be locked, and each of said openings is triangular and is defined by a through hole, triangular in cross-section, cut in the strip, and one edge of each of said triangular openings is perpendicular to the longitudinal axis of the strip whereby when one end of said strip is folded and passed through one of the openings adjacent the other end thereof to form a loop said one edge of one of said openings adjacent said one end is folded and can hook over the edges, other than said one edge, of said one opening adjacent the other end of the strip to lock the fastener.

4. An adjustable length fastener comprising:

an elongated strip of semi-rigid plastic, means defining a plurality of uniformly and longitudinally spaced and aligned openings in said strip and disposed over the entire length thereof, each of said openings being centrally disposed between the longitudinal edges of the strip, means defining a longitudinally extending hinge in the strip, said hinge being substantially centrally disposed between the longitudinal edges of the strip whereby said strip may be folded along said hinge and one end of said strip can be passed through one of said openings adjacent the other end thereof to form a loop which can be locked, each of said openings is rectangular and is defined by a substantially U-shaped slot cut through the strip and the portion of the strip interconnecting the free ends of the slot, each of said portions being perpendicular to the longitudinal axis of the strip, and a rectangular tongue projecting from each of said portions and normally filling the openings whereby when one end of said strip is folded and passed through one of the openings adjacent the other end thereof to form a loop one of the tongues adjacent said one end can hook over the bight of the U-shaped slot defining said one opening to lock the fastener.

5. An adjustable length fastener comprising:

an elongated strip of semi-rigid plastic, said strip having a pair of straight parallel longitudinal edges, means defining a plurality of uniformly and longitudinally spaced and aligned openings in said strip and disposed over the entire length thereof, each of said openings being centrally disposed between the longitudinal edges of the strip, means defining a longitudinally extending hinge in the strip, said hinge being substantially centrally disposed between the longitudinal edges of the strip whereby said strip may be folded along said hinge and one end of said strip can be passed through one of said openings adjacent the other end thereof to form a loop which can be locked, and each of said openings is rectangular and is defined by a through hole, rectangular in cross-section, cut in the strip, and first and second opposing edges of each of said rectangular openings are perpendicular to the longitudinal axis of the strip whereby when one end of the strip is folded and passed through one of the openings adjacent the other end thereof to form a loop the first edge of one of said openings adjacent said one end is folded and can hook over the second edge of said one opening adjacent the other end of the strip to lock the fastener.

6. An adjustable length fastener comprising:

an elongated strip of semi-rigid plastic, means defining a plurality of uniformly and longitudinally spaced and aligned openings in said strip and disposed over the entire length thereof, each of said openings being centrally disposed between the longitudinal edges of the strip, each of said openings being substantially triangular and defined by a through hole substantially triangular in cross-section, means defining a longitudinally extending hinge in the strip, said hinge being substantially centrally disposed between the longitudinal edges of the strip whereby said strip may be folded along said hinge and one end of said strip can be passed through one of said openings adjacent the other end thereof to form a loop which can be locked, said strip being narrower in the portions thereof between all next adjacent pairs of said openings than in the portions thereof coextensive with said openings, the longitudinal edges of said strip being mirror images of each other about the central longitudinal axis of the strip, and the longitudinal edges of the strip are substantially in the form of a sine curve whereby when one end of the strip is folded and passed through one of the openings adjacent the other end of the strip to form a loop one of the narrower portions of the strip, between next adjacent pairs of said openings adjacent said one end, engage said one opening adjacent the other end of the strip to lock the fastener.

7. An adjustable length fastener comprising:

an elongated strip of semi-rigid plastic, means defining a plurality of uniformly and longitudinally spaced and aligned openings in said strip and disposed over the entire length thereof, each of said openings being centrally disposed between the longitudinal edges of the strip, each of said openings being substantially triangular and defined by a through hole substantially triangular in cross-section, means defining a longitudinally extending hinge in the strip, said hinge being substantially centrally disposed between the longitudinal edges of the strip whereby said strip may be folded along said hinge and one end of said strip can be passed through one of said openings adjacent the other end thereof to form a loop which can be locked, said strip being narrow in the portions thereof between all next adjacent pairs of said openings than in the portions thereof coextensive with said openings, the longitudinal edges of said strip being mirror images of each other about the central longitudinal axis of the strip, and the narrower portions of said strip between next adjacent pairs of said openings and the portions thereof coextensive with said openings are both straight and parallel to the longitudinal axis of the strip and are interconnected by edge parts which extend transversely of the strip.

8. An adjustable length fastener as claimed in claim 7, wherein said edge parts are perpendicular to the longitudinal axis of the strip whereby when one end of the strip is folded and passed through one of the openings adjacent the other end thereof to form a loop, one of the narrower straight portions of the strip, between next adjacent pairs of said openings adjacent said one end, engage said one opening adjacent the other end of the strip with said edge parts in abutment with the portion of the strip coextensive with said one opening to lock the fastener.

9. An adjustable length fastener comprising:

an elongated strip of semi-rigid plastic, means defining a plurality of uniformly and longitudinally spaced and aligned openings in said strip and disposed over the entire length thereof, each of said openings being centrally disposed between the longitudinal edges of the strip, and means defining a longitudinally extending narrow groove in one of the surfaces of the strip, said groove extending completely between each pair of next adjacent openings and being substantially centrally disposed between the longitudinal edges of the strip whereby said strip may be folded along said groove and one end of said strip can be passed through one of said openings adjacent the other end thereof to form a loop which can be locked.

10. An adjustable length fastener comprising:

an elongated strip of semi-rigid plastic, means defining a plurality of uniformly and longitudinally spaced and aligned openings in said strip and disposed over the entire length thereof, each of said openings being centrally disposed between the longitudinal edges of the strip, and means defining a first longitudinally extending narrow groove in one of the surfaces of the strip, and a second longitudinally extending narrow groove in the other surface of the strip, said grooves being substantially centrally disposed between the longitudinal edges of the strip and extending continuously from one end thereof to the other except at said openings whereby said strip may be folded along said grooves and one end of said strip can be passed through one of said openings adjacent the other end thereof to form a loop which can be locked.

* * * * *